US010608346B2

(12) United States Patent
Greve

(10) Patent No.: US 10,608,346 B2
(45) Date of Patent: Mar. 31, 2020

(54) CIRCULARLY POLARIZED OMNI-DIRECTIONAL ANTENNA

(71) Applicant: Video Aerial Systems, LLC, Madison Heights, VA (US)

(72) Inventor: Charles A. Greve, Amherst, VA (US)

(73) Assignee: Video Aerial Systems, LLC, Madison Heights, VA (US)

( * ) Notice: Subject to any disclaimer, the term of this patent is extended or adjusted under 35 U.S.C. 154(b) by 0 days.

(21) Appl. No.: 15/793,941

(22) Filed: Oct. 25, 2017

(65) Prior Publication Data

US 2018/0269594 A1 Sep. 20, 2018

Related U.S. Application Data

(60) Provisional application No. 62/473,450, filed on Mar. 19, 2017.

(51) Int. Cl.

| | |
|---|---|
| ***H01Q 21/20*** | (2006.01) |
| ***H01Q 15/24*** | (2006.01) |
| ***H01Q 25/00*** | (2006.01) |
| ***H01Q 1/38*** | (2006.01) |
| ***H01Q 9/18*** | (2006.01) |
| *H01Q 1/40* | (2006.01) |
| *H01Q 1/42* | (2006.01) |
| *H01Q 9/38* | (2006.01) |

(52) U.S. Cl.

CPC ..... *H01Q 21/205* (2013.01); *H01Q 1/38* (2013.01); *H01Q 9/18* (2013.01); *H01Q 15/244* (2013.01); *H01Q 25/00* (2013.01); *H01Q 1/405* (2013.01); *H01Q 1/42* (2013.01); *H01Q 9/38* (2013.01)

(58) Field of Classification Search

CPC .... H01Q 15/24; H01Q 15/244; H01Q 21/205; H01Q 25/00; H01Q 9/18; H01Q 1/405; H01Q 1/42; H01Q 9/38

See application file for complete search history.

(56) References Cited

U.S. PATENT DOCUMENTS 6,334,048 B1 * 12/2001 Edvardsson ..... H01Q 11/08 343/702
6,538,611 B2 * 3/2003 Noro ..... H01Q 1/362 343/725

FOREIGN PATENT DOCUMENTS

WO WO-8504051 A1 * 9/1985 ..... H01Q 15/244

* cited by examiner

*Primary Examiner* — Hoang V Nguyen
(74) *Attorney, Agent, or Firm* — Rupak Nag

(57) ABSTRACT

Provided are examples of circularly polarized omni-directional antennas and methods of fabrication. In one aspect, an antenna comprises a central radiating element including a vertical center axis. The antenna further comprises a plurality of conducting elements surrounding the central radiating element. The plurality of conducting elements are curved about a circular circumference about the center axis and spaced equidistantly about the circular circumference. The central radiating element may be a sleeved dipole type. The plurality of conducting elements is configured to include an angle of tilt between 22 degrees and 68 degrees from horizontal. The plurality of conducting elements is located within a printed circuit board that is wrapped around the circumference around the center axis. Each conducting element of the plurality of conducting elements comprises a metallic wire.

21 Claims, 7 Drawing Sheets

CIRCULARLY POLARIZED OMNI-DIRECTIONAL ANTENNA

CROSS-REFERENCE TO RELATED APPLICATIONS

This application claims priority under 35 U.S.C. § 119(e) to U.S. Provisional Application No. 62/473,450, filed Mar. 20, 2017, entitled ION ANTENNA, the contents of which are hereby incorporated by reference.

TECHNICAL FIELD

The present disclosure relates generally to antenna systems, and more specifically to circularly polarized omni-directional antennas for uses including video piloting, drone vehicles (aircraft and ground), mesh networking, and Wi-Fi applications.

BACKGROUND

Antennas are electrical devices which convert electric power into radio waves, and vice versa. They are usually used with a radio transmitter or radio receiver. In transmission, a radio transmitter supplies an electric current to the antenna's terminals, and the antenna radiates the energy from the current as electromagnetic waves (radio waves). In reception, an antenna intercepts some of the power of an electromagnetic wave in order to produce an electric current at its terminals, and is applied to a receiver to be amplified.

Typically an antenna consists of an arrangement of metallic conductors (elements), electrically connected (often through a transmission line) to the receiver or transmitter. Antennas may also include additional elements or surfaces with no electrical connection to the transmitter or receiver, such as parasitic elements, parabolic reflectors or horns, which serve to direct the radio waves into a beam or other desired radiation pattern.

Antennas can be designed to transmit and receive radio waves in all horizontal directions equally (omnidirectional antennas), or preferentially in a particular direction (directional or high gain antennas). An omnidirectional antenna is a class of antenna which radiates radio wave power uniformly in all directions in one plane, with the radiated power decreasing with elevation angle above or below the plane, dropping to zero on the antenna's axis. Omnidirectional antennas oriented vertically are widely used for nondirectional antennas on the surface of the Earth because they radiate equally in all horizontal directions, while the power radiated drops off with elevation angle so little radio energy is aimed into the sky or down toward the earth and wasted. Omnidirectional antennas are widely used for radio broadcasting antennas, and in mobile devices that use radio such as cell phones, FM radios, walkie-talkies, wireless computer networks, cordless phones, GPS as well as for base stations that communicate with mobile radios, such as police and taxi dispatchers and aircraft communications.

SUMMARY

The following presents a simplified summary of the disclosure in order to provide a basic understanding of certain embodiments of this disclosure. This summary is not an extensive overview of the disclosure, and it does not identify key and critical elements of the present disclosure or delineate the scope of the present disclosure. Its sole purpose is to present some concepts disclosed herein in a simplified form as a prelude to the more detailed description that is presented later.

Provided are examples of circularly polarized omni-directional antennas and methods of fabricating such antennas. In one aspect, which may include at least a portion of the subject matter of any of the preceding and/or following examples and aspects, an antenna comprises a central radiating element including a vertical center axis. The antenna further comprises a plurality of conducting elements surrounding the central radiating element. The plurality of conducting elements are curved about a circular circumference about the center axis and spaced equidistantly about the circular circumference.

The antenna may further comprise a cover which comprises a base including an inner cylinder portion, and a cap including an outer cylinder portion. The base and the cap form a cavity interior to the inner cylinder portion. The central radiating element extends through an opening in the base such that a first end of the central radiating element is located within the cavity. The plurality of conducting elements are located within a space between the inner cylinder portion and the outer cylinder portion.

The central radiating element may be a sleeved dipole type. The plurality of conducting elements includes five conducting elements. The plurality of conducting elements are configured to include an angle of tilt between 22 degrees and 68 degrees from horizontal. The plurality of conducting elements are located within a printed circuit board that is wrapped around the circumference around the center axis. Each conducting element of the plurality of conducting elements comprises a metallic wire.

In another aspect, an antenna is provided comprising a cover comprising a base including an inner cylinder portion. The cover further comprises a cap including an outer cylinder portion. The base and the cap form a cavity interior to the inner cylinder portion.

The antenna further comprises a center radiating element extending through an opening in the base such that a first end of the center radiating element is located within the cavity. The cable may be aligned with a vertical center axis of the cover. In some embodiments, the center radiating element is a coaxial cable.

The antenna further comprises a plurality of conducting elements curved about a circumference around the center axis of the cover and spaced equidistantly about the circumference. The plurality of conducting elements is located within a space between the inner cylinder portion and the outer cylinder portion. Each conducting element of the plurality conducting elements may be configured to include an angle of tilt between 22 degrees and 68 degrees from horizontal. In particular embodiments, each conducting element of the plurality of conducting elements are configured to include an angle of tilt of 42 degrees from horizontal. The plurality of conducting elements may include five conducting elements. Each conducting element of the plurality of conducting elements may comprise a copper wire.

In particular embodiments, the radius ($r_i$), in inches, from the center axis to the plurality of conducting elements is equal to approximately 2.6535/f; wherein f is a desired operation frequency in gigahertz (GHz).

Other implementations of this disclosure include corresponding devices, systems, methods, and computer programs. For instance, a system is provided comprising a receiver and an antenna as previously described. In some embodiments, the antenna is coupled to the receiver via a coaxial radio frequency (RF) connector located at a second end of the center radiating element. In some embodiments, the center radiating element is directly coupled to a circuit board of a receiver. These other implementations may each optionally include one or more of the following features.

In another aspect, which may include at least a portion of the subject matter of any of the preceding and/or following examples and aspects, a method for constructing an antenna is provided. A cable is inserted through a first support collar such that an annular cavity is formed within the first support collar around the cable. The first support collar is bonded to a first end of the cable. A second end of the cable is then extended through an opening in a cover base that includes an inner cylinder portion having an interior surface and an exterior surface. The second end of the cable is located within a cavity defined by the interior surface of the inner cylinder portion and the first end of the cable is located external to the inner cylinder portion.

The cable is aligned with a center axis of the cover base. The second end of the cable is inserted through a second support collar such that the second support collar surrounds a portion of the cable within the cavity. The second support collar is bonded to the cable. A plurality of conducting elements is positioned about the inner cylinder portion such that the conducting elements are spaced equidistantly around a circumference around the center axis. The cavity is sealed by covering the cover base with a cover cap such that an outer cylinder portion of the cover top surrounds the exterior surface of the inner cylinder portion.

These and other embodiments are described further below with reference to the figures.

DETAILED DESCRIPTION OF EXAMPLE EMBODIMENTS

Figure 1B:
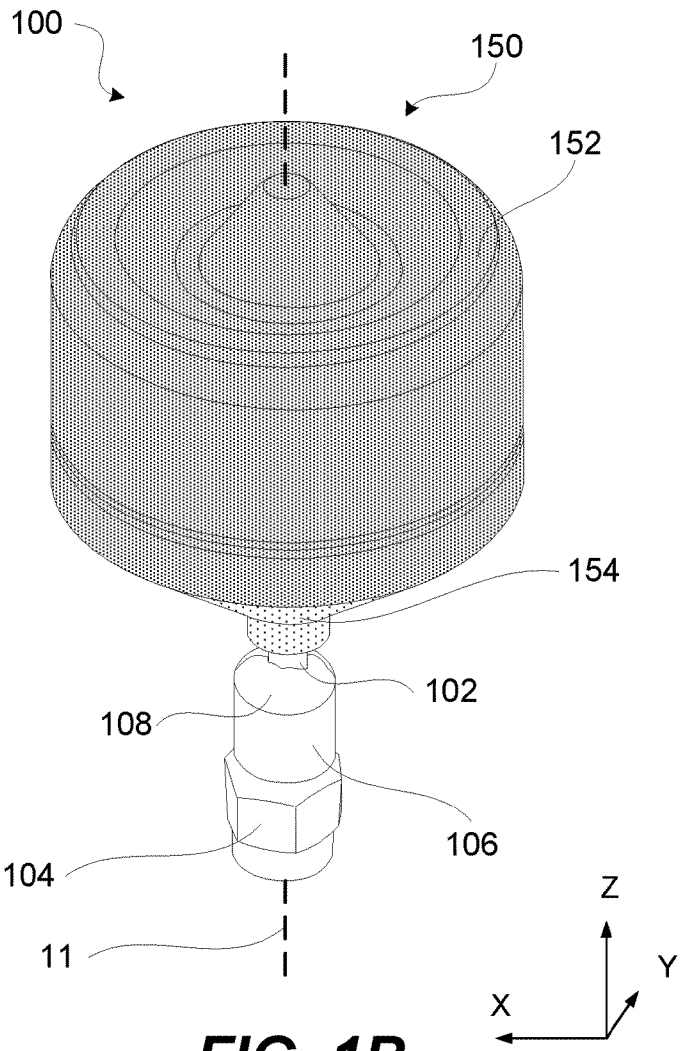
FIGS. 1A and 1B are perspective views of an example omni-directional antenna, in accordance with one or more embodiments.

Reference will now be made in detail to some specific examples of the invention including the best modes contemplated by the inventors for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims.

For example, the techniques of the present invention will be described in the context of particular machines, such as drones. However, it should be noted that the techniques of the present invention apply to a wide variety of different machines that may require remote wireless control. As another example, the techniques of the present invention will be described in the context of particular wireless signals, such as Wi-Fi. However, it should be noted that the techniques of the present invention apply to a wide variety of different wireless signals, including Bluetooth, infrared, line of sight transmission mechanisms, as well as various other networking protocols.

In the following description, numerous specific details are set forth in order to provide a thorough understanding of the present invention. Particular example embodiments of the present invention may be implemented without some or all of these specific details. In other instances, well known process operations have not been described in detail in order not to unnecessarily obscure the present invention.

Various techniques and mechanisms of the present invention will sometimes be described in singular form for clarity. However, it should be noted that some embodiments include multiple iterations of a technique or multiple instantiations of a mechanism unless noted otherwise. For example, a system uses a processor in a variety of contexts. However, it will be appreciated that a system can use multiple processors while remaining within the scope of the present invention unless otherwise noted. Furthermore, the techniques and mechanisms of the present invention will sometimes describe a connection between two entities. It should be noted that a connection between two entities does not necessarily mean a direct, unimpeded connection, as a variety of other entities may reside between the two entities. For example, a processor may be connected to memory, but it will be appreciated that a variety of bridges and controllers may reside between the processor and memory. Consequently, a connection does not necessarily mean a direct, unimpeded connection unless otherwise noted.

Various embodiments are provided which describe a circularly polarized omni-directional antenna. Antennas as described herein may be referred to herein as an Ion antenna. Such antennas may have implementations in a variety of fields, including, but not limited to video piloting, drone vehicles (aircraft and ground, mesh networking, and Wi-Fi applications. In various embodiments, the antenna uses a central radiating element surrounded by curved parasitic radiating elements. Such parasitic radiating elements may be wire type or printed on a printed circuit board (PCB). The antenna's central radiating element may be a center-fed sleeved dipole type which may be balanced by a separate sleeve choke dipole type with incorporated balun. The parasitic radiating elements may be curved about the central radiating element. The radiating elements may be fully encapsulated within a cover. Accordingly, various embodiments described in the present disclosure provide a lightweight omni-directional antenna that includes reduced sizing with greater durability and that may be implemented in a variety of systems.

Figure 1A:
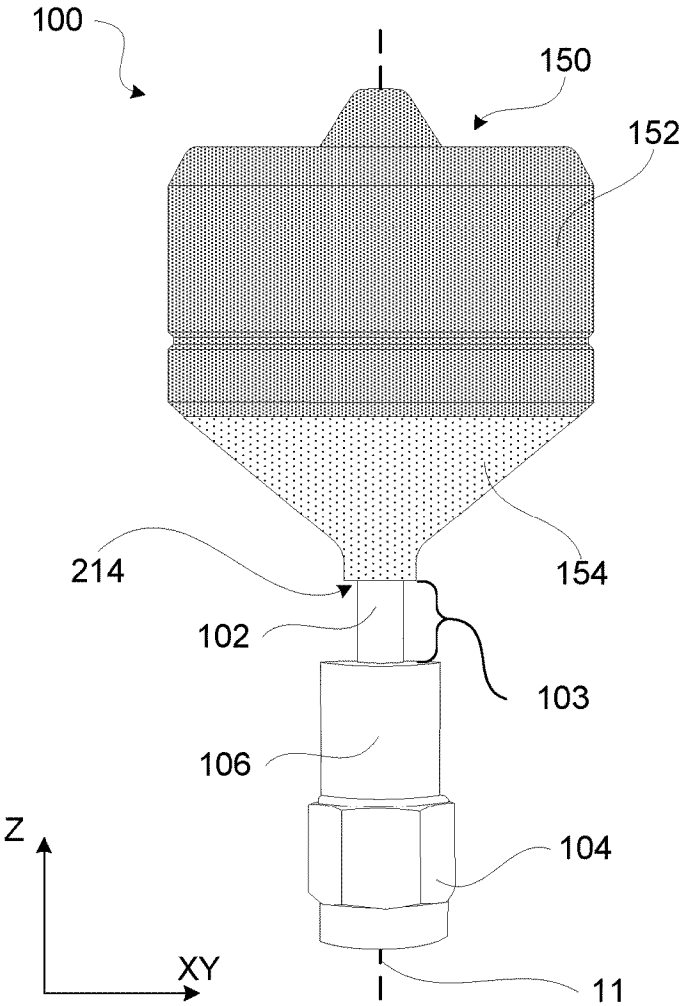

With reference to FIGS. 1A and 1B, shown are perspective views of an example omni-directional antenna 100, in accordance with one or more embodiments. In various embodiments, antenna 100 includes cover 150. In some embodiments, cover 150 may be a cylindrical enclosure that comprises a cap 152 and a base 154. In various embodiments, cover 150 may be constructed from a non-conductive material, such as plastic. An example embodiment of a cap 152 and base 154 are depicted in FIGS. 1A and 1B with different shading to delineate each portion more clearly. Antenna 100 may comprise a central radiating element 102. In some embodiments, central radiating element 102 may comprise a cable. As used herein, the central radiating element 102 may be referred to as cable 102. In some embodiments, cable 102 extends into cover 150 through a cable opening 214 (further described below) in base 154. Thus a first end 102-A of the cable 102 is within the cover 150 and a second end 102-B of the cable 102 is external to the cover.

In various embodiments, cable 102 comprises a coaxial cable, such as an RG405 coaxial cable, for example. In other embodiments, cable 102 may comprise any other type of cable with the appropriate electromagnetic characteristics. In some embodiments, the cable may include a characteristic impedance between 25 and 100 Ohms. Such other cables may include an RG316 coaxial cable. In various embodiments, cable 102 may include several layers. The outermost layer may be a jacket, such as a 2.5 mm fluoropolymer jacket. The next layer may be an outer conductor or shield, such as a 2.20 mm layer of tin-soaked tin plated copper layer. The next layer may be an insulation layer, such as a 1.70 mm layer of solid extruded PTFE. The innermost layer may be an inner conductor, such as a 0.56 mm silver plated copper wire. In various embodiments, cable 102 may comprise a combination of one or more of the aforementioned layers.

The second end 102-B of cable 102 may be coupled to a coaxial radiofrequency (RF) connector 104. For example, coaxial RF connector 104 may be a SubMiniature version A (SMA) connector. As another example, coaxial RF connector 104 may be a U.FL connector, or any other suitable miniature RF connector for high-frequency signals. In some embodiments, coaxial RF connector 104 may be an integral part of cable 102. In various embodiments, various types of connectors 104 may be implemented to electrically connect antenna 100 with a circuit board of a transceiver or other device. In some embodiments, cable 102 may be directly coupled to a circuit board without using a connector 104. For example, second end 102-B may be directly soldered to the circuit board.

In some embodiments a support collar 106 may be symmetrically positioned around a portion of cable 102 adjacent to the coaxial RF connector 104. In some embodiments, the support collar 106 may comprise a metallic material. For example, support collar 106 may be a brass collar, such as a 9/32" by 0.31" brass collar, for example. The support collar 106, along with cable 102, forms the sleeve choke dipole type with incorporated balun. Support collar 106 may serve as a balun which may function to convert between a balanced signal (two signals working against each other where ground is irrelevant) and an unbalanced signal (a single signal working against ground or pseudo-ground), and affecting the tuning of the antenna to a specific desired frequency.

The annular space between the interior surface of support collar 106 and the cable 102 may be filled with material 108. Such material 108 may be used to further secure support collar 106 to cable 102 and/or coaxial RF connector 104. For example, material 108 may include a combination of one or more of a solder and a glue, such as polyamide plastic or polyamide glue. In some embodiments, material 108 comprising polyamide plastic may comprise a dielectric material which may affect the effective balancing effect. As such, the amount of material 108 used within support collar 106 may affect the overall length and/or width of support collar 106. In some embodiments, material 108 may function as electrical and/or thermal insulation. Support collar 106 may additionally function to support a portion of cable 102 from directional forces to prevent bending of cable 102. In some embodiments a segment 103 of the cable 102 may exist unsupported or uncovered between base 154 and support collar 106 which may allow antenna 100 to bend or flex about segment 103. The structure of antenna 100 is symmetrical about a longitudinal center axis 11.

Figure 2A:
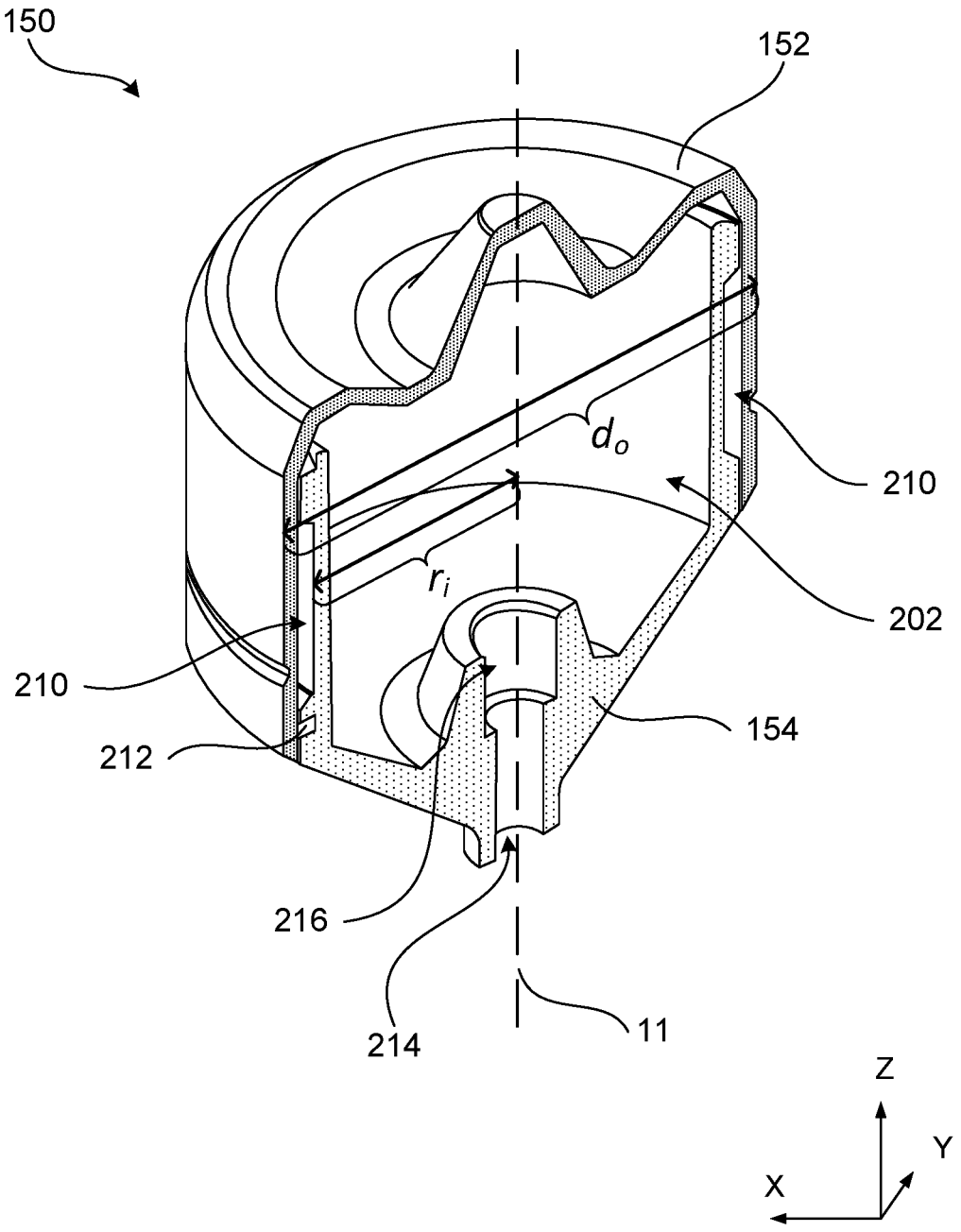
FIG. 2A is a perspective cross-sectional view of an example cover for an omni-directional antenna, in accordance with one or more embodiments.
Figure 2B:
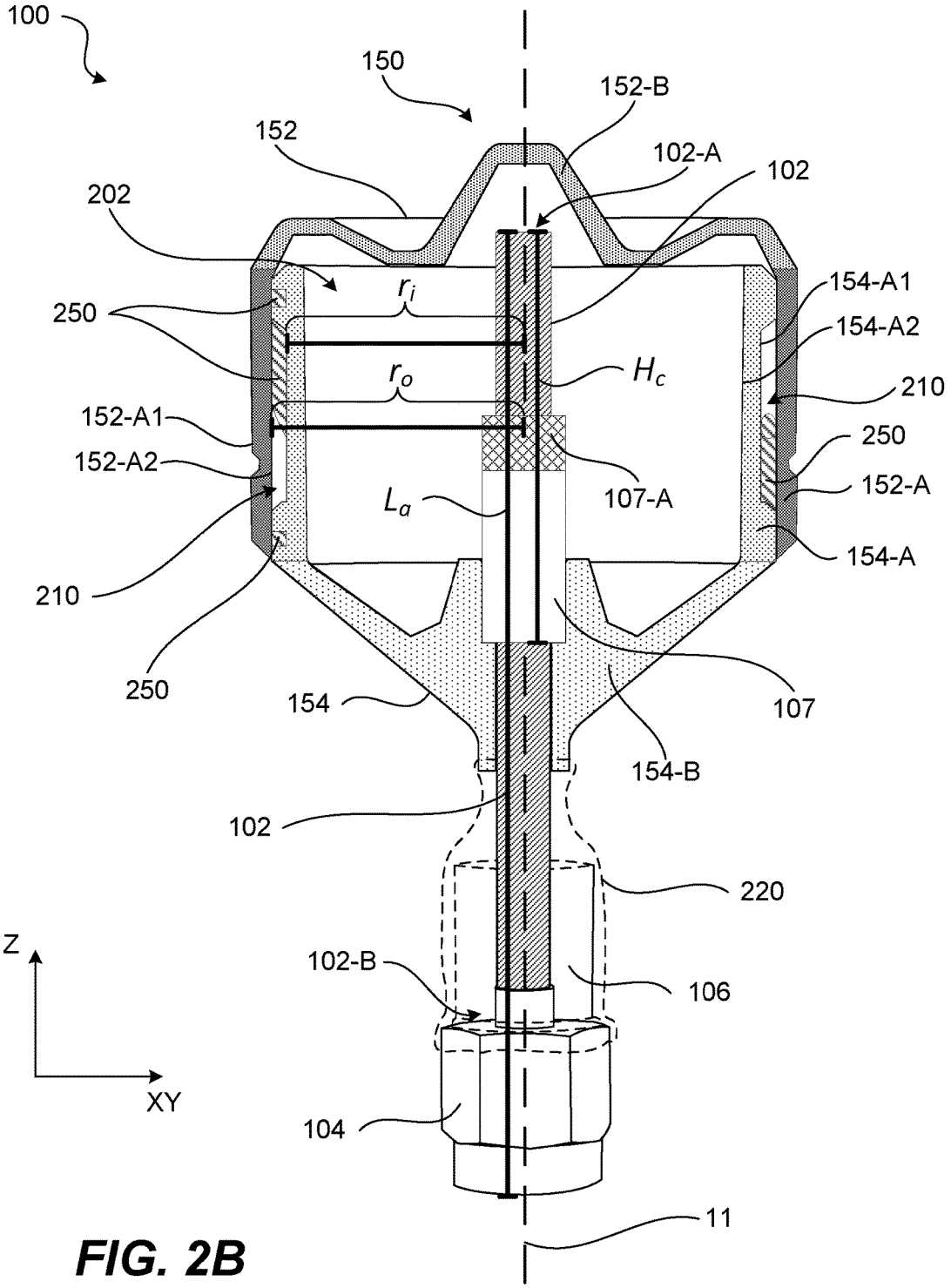
FIG. 2B is a cross-sectional view of an example omni-directional antenna, in accordance with one or more embodiments.

With reference to FIGS. 2A and 2B, shown are perspective cross-sectional views of antenna 100 and cover 150 to better illustrate the internal configuration of components. FIG. 2A illustrates a perspective cross-sectional view of an example cover 150 for an omni-directional antenna 100, in accordance with one or more embodiments. FIG. 2B illustrates a cross-sectional view of an example omni-directional antenna 100, in accordance with one or more embodiments. In various embodiments, the components of cover 150 may be manufactured by various manufacturing processes, such as traditional machining, injection molding, 3D printing, or various other manufacturing processes.

In example embodiments, cap 152 includes an outer cylinder portion 152-A and an upper cylinder portion 152-A. Base 154 includes an inner cylinder portion 154-A and a lower cylinder portion 154-B. Outer cylinder portion 152-A, upper cylinder portion 152-B, inner cylinder portion 154-A, and lower cylinder portion 154-B are depicted in FIG. 2B with variations in shading to better indicate the structure of cap 152 and base 154 of cover 150. As illustrated, each of outer cylinder portion 152-A, upper cylinder portion 152-B, inner cylinder portion 154-A, and lower cylinder portion 154-B have an interior surface and an exterior surface. For example, outer cylinder portion 152-A includes exterior surface 152-A1 and interior surface 152-A2, while inner cylinder portion 154 includes exterior surface 154-A1 and interior surface 154-A2.

The exterior surface 152-A1 and interior surface 152-A2 of outer cylinder portion 152-A may be continuous with the exterior surface and the interior surface, respectively, of the upper cylinder portion 152-B. Similarly the exterior surface 154-A1 and interior surface 154-A2 of the inner cylinder portion 154-A may be continuous with the exterior surface and the interior surface, respectively, of the lower cylinder portion 154-B. In various embodiments, the exterior surface 152-A1 of the outer cylinder portion 152-A, and the exterior surface of the upper cylinder portion 152-B, and/or the exterior surface of the lower cylinder portion 154-B may include a non-cylindrical shape (not shown). For example, the exterior surfaces may be formed in the shape of a cube. In other embodiments, the exterior surfaces of the cover 150 may be formed to include any three-dimensional shape.

The cap 152 may engage with the base 154 such that the interior surface 152-A2 of the outer cylinder portion 152-A surrounds the exterior surface 154-A1 of the inner cylinder portion 154-A, such that a cavity 202 is formed within the inner cylinder portion 154-A and the interior surface of upper cylinder portion 152-B. Lower cylinder portion 154-B of base 154 may include cable opening 214 through which cable 102 may be extended into cavity 202. In some embodiments, cable opening 214 may open into an enlarged bore 216. The enlarged bore may be configured to house an additional support collar 107, which may be of various sizes (depicted in FIG. 2B). As depicted cable opening 214 and enlarged bore 216 are centered about the longitudinal center axis 11.

In various embodiments, an intercover space 210 may be formed between the interior surface 152-A2 of outer cylinder portion 152-A and the exterior surface 154-A1 of inner cylinder portion 154-A. In some embodiments, intercover space 210 may be an annular space which may be configured to house wire elements 250, as further depicted in FIGS. 3A and 3B. In some embodiments base 154 is configured to include wire notches 212 within the intercover space 210 for supporting and securing wire elements 250. In some embodiments wire notches 212 may be included on the cap 152, such as on the interior surface 152-A2 of the outer cylinder portion 152-A.

In some embodiments, the cover 150 may be configured such that the cap 152 is fit within base 154, such that the walls of the cap 152 may form the inner cylinder portion, while the walls of the base 154 may form the outer cylinder portion. In such embodiments, the intercover space 210 may be formed between an outer surface of cap 152 and an inner surface of base 154. In such embodiments, wire notches 212 may be located on the outer surface of cap 152 or the inner surface of base 154.

As shown in FIG. 2B, an inner support collar 107 may be positioned around cable 102. The support collar 107, along with cable 102, forms a center-fed sleeved dipole type central radiating element of antenna 100. In various embodiments, inner support collar 107 may be a metallic collar. For example, inner support collar 107 may be a 5/32" by 0.44" brass collar. Inner support collar 107 may be secured to the lower cylinder portion 154-B of base 154 with glue or other appropriate adhesive.

In some embodiments, inner support collar 107 may be soldered to cable 102 to secure support collar 107 in place relative to cable 102. In some embodiments one or more inner layers of cable 102 may be exposed from the outermost jacket layer. For example, the outer conductor layer of cable 102 may be exposed along the portion of cable 102 that is located within the inner support collar 107. Support collar 107 may be positioned to be level with an end of the exposed cable shield. In some embodiments, inner support collar 107 may be soldered to one or more portions of the outer conductor layer of cable 102. In some embodiments, upper portion 107-A of inner support collar 107 may include a smaller diameter in order to grip the corresponding portion of cable 102. For example, upper portion 107-A may be crimped with a crimper plier. This provides additional stability and forces cable 102 to remain centered with respect to support collar 107. In various embodiments, the crimping or other reduction in diameter of upper portion 107-A may affect the effective balancing of antenna 100 by changing the dielectric properties of the corresponding portion of cable 102 and causing support collar 107 to act as a balun, as well as a counter-element.

In some embodiments, a covering material 220 (shown in dashed lines) may cover a portion of the antenna 100 for insulation or protection from dust, dirt, wear, and/or damage. As shown in FIG. 2B, covering material 220 covers a bottom portion of lower cylinder portion 154-B to a top portion of coaxial RF connector 104. For example, covering material 220 may comprise heat shrink tubing or any other material with appropriate characteristics, such as non-conductivity, flexibility, or durability.

Figure 3A:
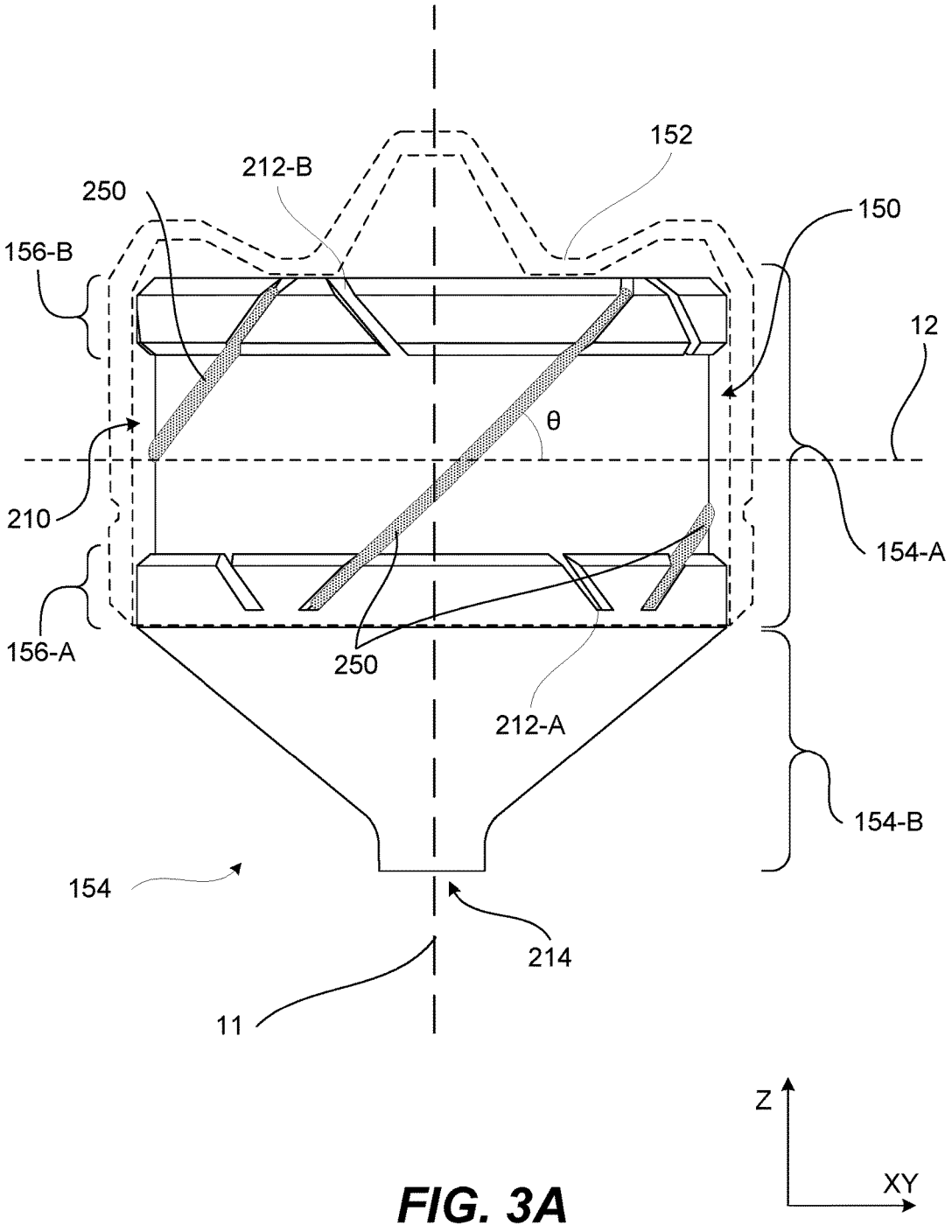
FIGS. 3A and 3B are perspective views of a base of an example cover for an omni-directional antenna, in accordance with one or more embodiments.
Figure 3B:
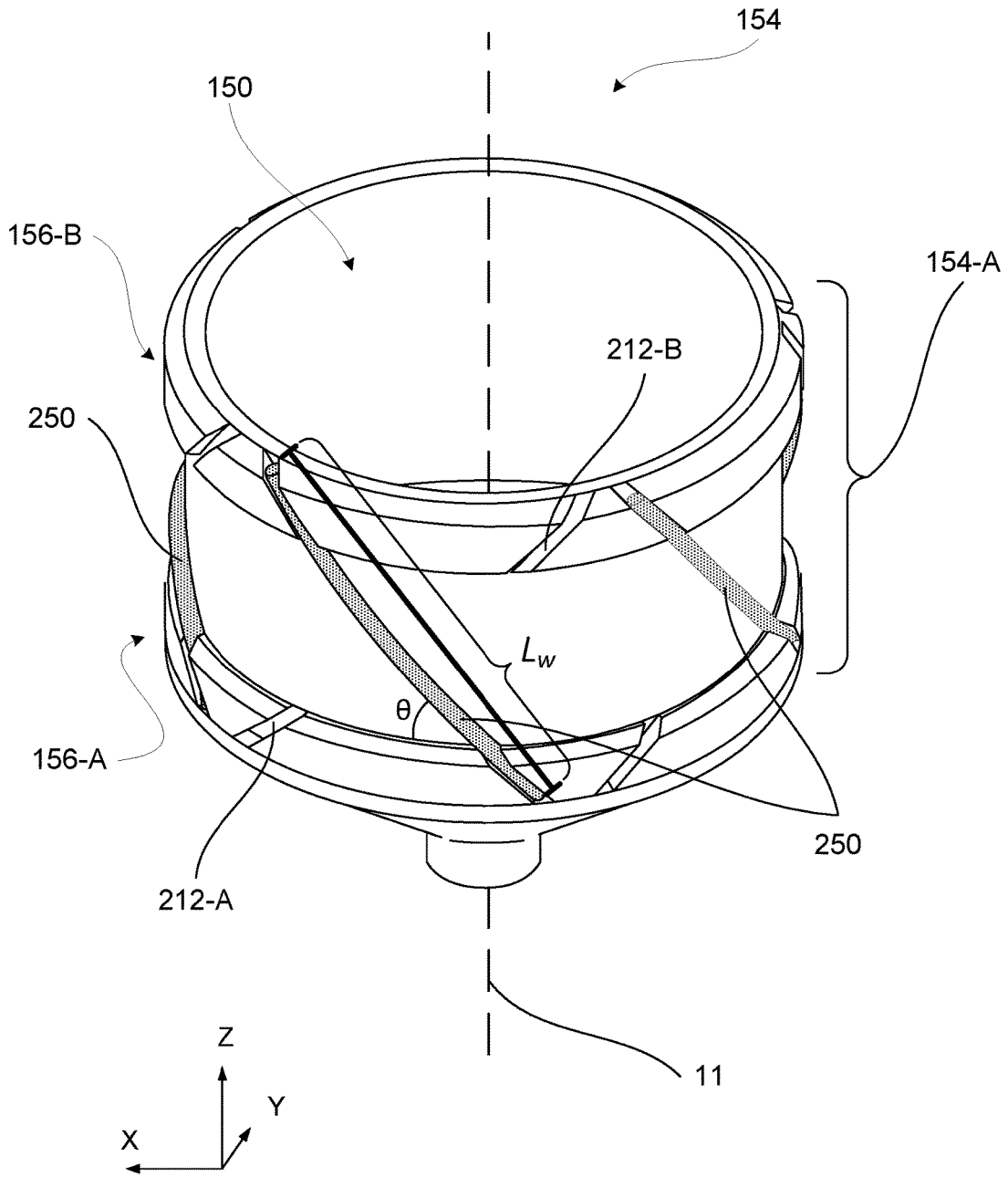

With reference to FIGS. 3A and 3B, shown are perspective views of a base 154 of an example cover 150 for an omni-directional antenna 100, in accordance with one or more embodiments. As depicted in FIG. 3A, the location of cap 152 is shown as dotted lines to indicate where cap 152 may be situated relative to base 154.

In various embodiments, a plurality of conducting elements 250 is arranged equidistantly around center axis 11. In some embodiments, conducting elements 250 may comprise wires of various metals such as copper wires. For example, wire elements 250 may be 26 AWG wires. However, in various embodiments, conducting elements 250 may comprise any one of various metallic wires or strips with appropriate electromagnetic characteristics. As used herein, conducting elements may also be referred to as wires, strips, or parasitic elements. In some embodiments, conducting elements 250 may be secured within intercover space 210. In some embodiments, conducting elements 250 may be positioned within cavity 202 or external to outer cavity portion 152-A. In example embodiments, conducting elements 250 are arranged equidistantly within the intercover space 210. In some embodiments, antenna 100 may include five (5) conducting elements 250. However any number of conducting elements may be included within intercover space 210. For example, there may be as few as three (3) wires or as many as eight (8) conducting elements. In some embodiments, there may be fewer than three (3) wires or more than eight (8) conducting elements.

In some embodiments, the plurality of conducting elements 250 are configured to include an angle of tilt from horizontal. As shown in FIG. 3A, there is an angle θ between wire elements 250 and a horizontal axis 12. In various embodiments, the angle θ may be between 22 degrees and 68 degrees. For example wire elements 250 may be configured to include an angle of tilt of 42 degrees from horizontal. However, in other embodiments, the angle of tilt from horizontal of conducting elements 250 may be less than 22 degrees or more than 68 degrees. In example embodiments, the conducting elements 250 may be arranged to provide a right hand circular polarization (RHCP) or a left hand circular polarization (LHCP). As shown in FIG. 3A, the wire elements 250 are arranged to tilt diagonally upward to the right providing a left hand circular polarization. As shown in FIG. 3B, the wire elements 250 are arranged to tilt diagonally upward to the left providing a right hand circular polarization.

In some embodiments, conducting elements 250 may be secured to the outer cylinder portion 152-A and/or inner cylinder portion 154-A. For example, conducting elements 250 may be glued to a surface 154-A1 or 154-A2 of inner cylinder portion 154-A. In other examples, conducting elements 250 may be glued to a surface 152-A1 or 152-A2 of outer cylinder portion 152-A.

In some embodiments, conducting elements 250 may be conductive materials embedded within a printed circuit board (PCB). The printed circuit board may be flexible enough to roll and/or bend about the circumference of inner cylinder portion 154-A. In some embodiments the length of the printed circuit board may cover the circumference of the exterior surface 154-A1 of inner cylinder portion 154-A. In some embodiments, the printed circuit board may be attached to a surface 154-A1 or 154-A2 of inner cylinder portion 154-A with glue or other appropriate adhesive. In some embodiments, printed circuit board may be attached to a surface 152-A1 or 152-A2 of outer cylinder portion 152-A with glue or other appropriate adhesive.

As illustrated, in some embodiments, the exterior surface 154-A1 of inner cylinder portion 154-A may include wire notches 212 configured to secure wire elements 250 with proper spacing and in appropriate orientations. In some embodiments, a set of wire notches 212 comprise a lower notch 212-A and an upper notch 212-B which are aligned diagonally. Each set of wire notches 212 may form a channel in which a wire element may fit. In some embodiments, the channel formed by a set of wire notches 212 may be not be continuous. For example, as shown in FIGS. 3A and 3B, the lower notches 212-A are integrated within a lower rim 156-A of the inner cylinder portion 154-A, and the upper notches 212-B are integrated within an upper rim 156-B of the inner cylinder portion 154-A. However, in some embodiments, no channel structure exists in between the notches along the height of inner cylinder portion 154, as depicted in FIGS. 3A and 3B. However, in some embodiments, a track formed by notches 212 may be continuous along the height of inner cylinder portion 154.

In some embodiments, the inner cylinder portion 154 may include two series of notches 212. One series of notches may be used to arrange the wire elements for RHCP, while the other series of notches may be used to arrange the wire elements for LHCP. The wire elements may further be secured to inner cylinder portion 154-A with a glue or other appropriate adhesive. The wire elements 250 may be situated completely against the curved surface of the exterior surface 154-A1 of the inner cylinder portion 154, and thus the wire elements 250 may be curved along the exterior surface 154-A1 of the inner cylinder portion 154-A. In some embodiments, the wire elements 250 may be curved to the same degree as the exterior surface 154-A1 of the inner cylinder portion 154-A. In some embodiments the wire notches 212 may be attached to the interior surface 152-A2 of the outer cylinder portion 152, and the wire elements 250 may be secured to the outer cylinder portion 152. In various other embodiments, outer cylinder portion 152 or inner cylinder portion 154 may include other support structures to support or guide wire elements 250.

In various embodiments, cable 102 comprises a sleeved dipole that may be used as a feed and the active part of the antenna 100. In some embodiments, the wire elements 250 may function as parasitic radiating elements. In some embodiments, wire elements 250 may radiate out at 180 degrees from the center radiating element at a particular desired tuned frequency. For example, wire elements 250 form inductively resonant cage and the length, shape, and width of the wire elements and/or angle of tilt of the wire elements may change the harmonics of the radiation of the inductively resonant cage.

Because the conducting elements 250 are situated against the exterior surface 154-A1 of the inner cylinder portion 154-A, the conductors 250 may curve along with the exterior surface 154-A1 allowing the antenna size and gain to be adjusted. Because the conducting elements 250 are contained within intercover space 210 and fully covered by cap 152, the parasitic radiating elements of antenna are less subject to damage or wear as compared to other similar functioning antennas. For example, a Lindenblad antenna may use four, dipole, driven-elements to create a circularly polarized, omni-directional radiation pattern. As another example, a Yagi-Uda antenna may include several parasitic elements that serve as passive radiators to reradiate the radio waves to modify radiation patterns. However, such radiating elements are generally not covered and may be more subject to damage and wear.

In various embodiments, the length of cable 102 may vary. In some embodiments, the cable may be a 54 millimeter (2") 41 millimeter (1.65") RG405 coaxial cable. However, the length of cable 102 may be trimmed to achieve a desired standing wave ratio (SWR) at a given frequency. For example, an SWR of less than 1.5 may be desired for a frequency of 5800 MHz.

In various embodiments, the frequency of operation (f) of antenna 100 may depend on a combination of the length and size of cable 102, the length and placement of conducting elements 250, and the size of support collars 106 and 107. For example, for a given arrangement of components, the operation frequency (f) in gigahertz (GHz) may be approximated by the following equation:

$$f=5125/H_c$$

where $H_c$ is the antenna head height of the cable 102 from first end 102-A in cavity 202 to the base of the support collar 107, as shown in FIG. 2B. The antenna head height $H_c$ may also refer to the active section of the antenna 100. The radiation pattern may also depend on the distance of wire elements 250 from the center axis 11. The equations above may be approximations and may include a margins of error. For example, the frequency measurements based on the antenna head height may be about +/−20%.

With reference back to FIG. 2B, in some embodiments, cable 102 includes an total antenna length ($L_a$) from the first end 102-A of cable 102 to the base of coaxial RF connector 104. In some embodiments, the total antenna length ($L_a$) may correspond to the desired operation frequency of the antenna. For example, for a given arrangement of components, the total antenna length ($L_a$) of antenna 102, in inches, may be equal to approximately f/3625, where f is the desired operation frequency in megahertz (MHz). The margin of error for the total antenna length ($L_a$) may be +/−15%.

The conducting elements 250 may be of various lengths in various embodiments. In some embodiments, the conducting elements 250 are of uniform length. In some embodiments, the conducting elements 250 may be positioned such that the centers of the conducting elements 250 are aligned at the same height position as the end of the top portion 107-A of inner support collar 107. The length ($L_w$) of the parasitic elements may be approximated by the equation:

$$L_w=3885/f$$

where $L_w$ is the length of a wire element in inches, and f is the frequency in MHz. There is a margin of error of +/−20% in this measurement depending on location and materials used.

As previously described, above conducting elements 250 are positioned within intercover space 210 along the external surface 154-A1 of the inner cylinder portion 154-A. In some embodiments, the radius, in inches, from the center axis 11 to the exterior surface 154-A1 of the inner cylinder portion 154-A (re) will typically range from 4350/f to 1160/f; where f is the desired operation frequency in MHz. In some embodiments, radius ($r_i$) may also correspond to the distance between the conducting elements 250 and the center axis 11.

Figure 4:
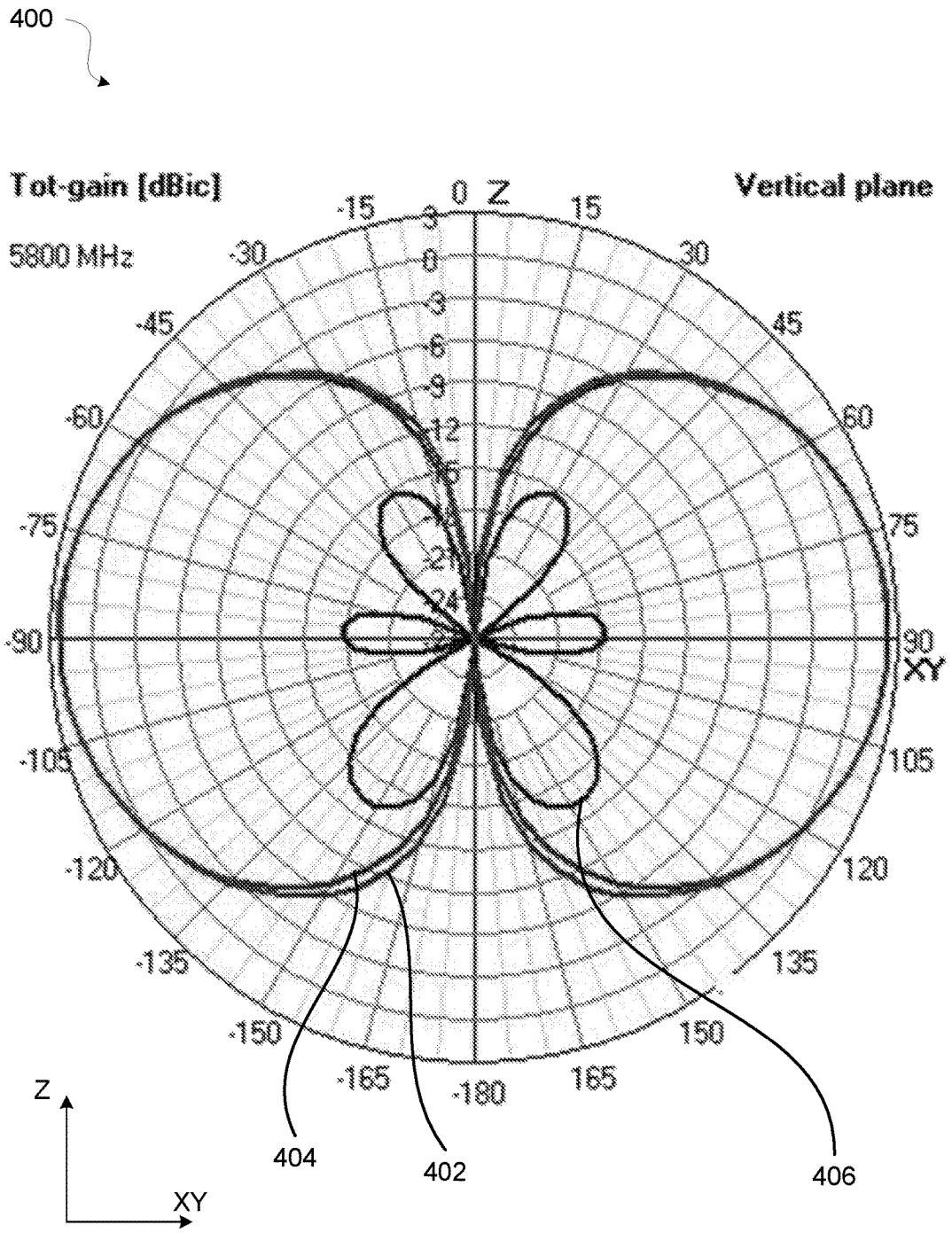
FIG. 4 is an example radiation pattern graph of an omni-directional antenna, in accordance with one or more embodiments.

FIG. 4 is an example radiation pattern graph 400 of an omni-directional antenna, in accordance with one or more embodiments. The graph shows radiation pattern of an example of a right hand circular polarization configuration of antenna 100. The graph shows the total gain 402 (outermost pattern), dominant rotation pattern 404 (middle pattern), and recessive pattern 406 (innermost pattern). The conducting elements may be reversed in direction to change the recessive and dominant antenna patterns from RHCP to LHCP and LHCP to RHCP. Additionally, the location of the conducting elements will change the pattern of the antenna.

Figure 5:
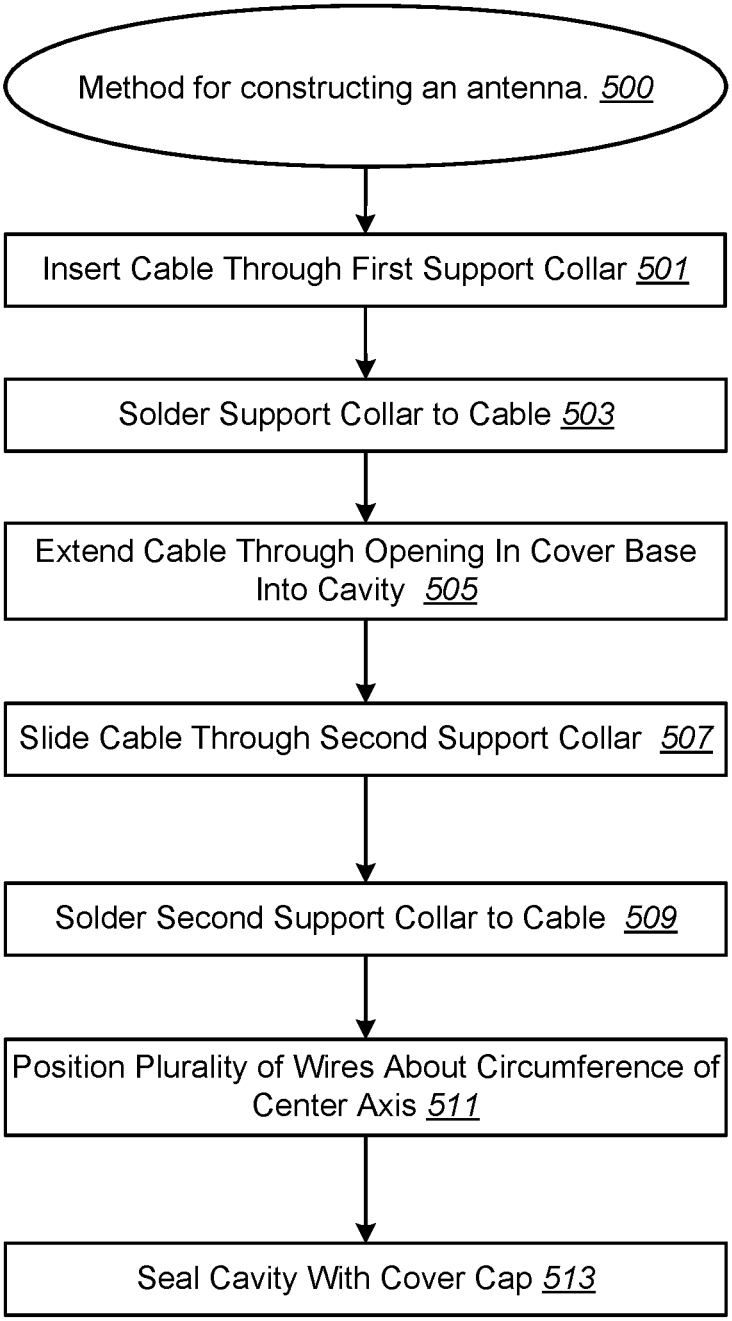
FIG. 5 is an example method of constructing an omni-directional antenna, in accordance with one or more embodiments.

FIG. 5 is an example method 500 of constructing an omni-directional antenna, in accordance with one or more embodiments. At step 501 a cable is inserted through a first support collar such that an annular cavity is formed within the first support collar around the cable. In some embodiments, the cable may be cable 102 and the first support collar may be support collar 106. At step 503, the first support collar is soldered to a first end of the cable. As previously described, cable 102 may include a coaxial RF connector 104 that is integral to cable 102 at a second end 102-B. Here, the first end of the cable may be the second end 102-B. As such, the support collar may be attached to the coaxial RF connector portion of the cable, such as by soldering.

Step 503 may be performed by placing the cable in a solder rack with the support collar. Next, solder material may be placed into the annular cavity. For example, two half inch sections of 0.31" diameter solder material or one half inch section of about 0.62" diameter solder material may be placed into the annular cavity. The support collar may be inserted into an inductive heater for approximately 15 seconds until the solder is liquefied. Other appropriate heating methods may be implemented to attach support collar, such as by oven. Polyamide plastic may then then be injected into any remaining space in the annular cavity until the annular cavity is completely filled and the polyamide plastic is level with the upper rim of the support collar.

At step 505, a second end of the cable is extended through an opening in a cover base, such as base 154 of cover 150. The cover base may include an inner cylinder portion, such as inner cylinder portion 154-A, having an interior surface 154-A2 and an exterior surface 154-A1. The second end of the cable, may be first end 102-A, is located within a cavity, such as cavity 202, defined by the interior surface 154-A2 of the inner cylinder portion 154-A, as depicted in previous FIG. 2B. The first end of the cable, such as second end 102-B, may be located external to the inner cylinder portion, as depicted in previous FIG. 2B. The cable is aligned with a center axis of the cover base, such as center axis 11.

At step 507, the cable may be inserted through a second support collar such that the second support collar surrounds a portion of the cable within the cavity. In some embodiments, the second support collar may be inner support collar 107 which surrounds a portion of cable 102 within cavity 202, as shown in FIG. 2B. In some embodiments, a top portion of the second support collar, such as top portion 107-A, may be crimped. For example, the first 1/16" to 1/8" of the top portion of the second support collar may be crimped with a 0.128" crimp tool. As previously described, the crimped portion of the second support collar may serve to grip against the cable and keep the cable centered relative to the second support collar. At step 509, the second support collar is soldered to the cable. In some embodiments, the second support collar may be soldered to an exposed cable shield of the cable, such as the outer conductor layer. In some embodiments, the second support collar may also be attached to the cover base, such as within the enlarged bore 216.

At step 511, a plurality of conducting elements is positioned about the cylinder portion such that the wire elements are spaced equidistantly around cavity circumference around the center axis 11. The conducting elements may be attached via glue or other method. In some embodiments, conducting elements may be included in a printed circuit board and wrapped around the circumference. In some embodiments the conducting elements may be conducting elements 250. As previously described, any number of conducting elements may be included. For example, antenna 100 may include five (5) wire elements spaced equidistantly around cavity 202.

At step 513, the cavity may be sealed by covering the cover base with a cover cap such that an outer cylinder portion of the cover cap surrounds the exterior surface of the inner cylinder portion. For example, the cover cap may be cap 152 of cover 150, and the outer cylinder portion may be outer cylinder portion 152-A. The cover cap may be secured to the cover base with a glue or other appropriate adhesive. Once secured in place, an intercover space, such as intercover space 210, may be formed between the outer cylinder portion of the cover cap and the inner cylinder portion of the cover base. The plurality of conducting elements may be located within such intercover space, as described with reference to FIGS. 2A, 2B, and 3A.

In some embodiments, each of the conducting elements may be configured to attach to the exterior surface of the inner cylinder at an angle with respect to horizontal. In some embodiments, the conducting elements may be configured to include an angle of tilt of about 42 degrees from horizontal. However, in some embodiments, the conducting elements may be configured to include an angle of tilt between 22 degrees and 68 degrees from horizontal. Each conducting element may include the same angle of tilt. In some embodiments, the conducting elements may be attached to other portions of the cover, such as cover 150. For example, conducting elements may be alternately attached to the interior surface of the outer cylinder portion of the cover cap.

As previously described, the conducting elements may be positioned such that the centers of the conducting elements are aligned at the same position as the end of the top portion of inner support collar of the second support collar, such as top portion 107-A of inner support collar 107. The conducting elements may also be place at a certain distance from the cable or the center axis of the antenna, such as center axis 11.

Although many of the components and processes are described above in the singular for convenience, it will be appreciated by one of skill in the art that multiple components and repeated processes can also be used to practice the techniques of the present disclosure.

While the present disclosure has been particularly shown and described with reference to specific embodiments thereof, it will be understood by those skilled in the art that changes in the form and details of the disclosed embodiments may be made without departing from the spirit or scope of the disclosure. It is therefore intended that the disclosure be interpreted to include all variations and equivalents that fall within the true spirit and scope of the present disclosure. Although many of the components and processes are described above in the singular for convenience, it will be appreciated by one of skill in the art that multiple components and repeated processes can also be used to practice the techniques of the present disclosure.

What is claimed is:

1. An antenna comprising:

a central radiating element including a vertical center axis; and a plurality of conducting elements surrounding the central radiating element, wherein the plurality of conducting elements are curved about a circular circumference about the center axis and spaced equidistantly about the circular circumference; and a cover configured to encapsulate the central radiating element, the cover comprising:

a base comprising an inner cylinder portion and a lower cylinder portion, the inner cylinder portion comprising an upper rim and a lower rim each comprising a plurality of notches associated with the plurality of conducting elements; and a cap comprising an outer cylinder portion, the cap further comprising a rigid non-conductive material.

2. The antenna of claim 1, wherein the base and the cap form a cavity interior to the inner cylinder portion;

wherein the central radiating element extends through an opening in the base such that a first end of the central radiating element is located within the cavity;

wherein the plurality of conducting elements are located within a space between the inner cylinder portion and the outer cylinder portion.

3. The antenna of claim 1, wherein the central radiating element is a sleeved dipole type.

4. The antenna of claim 1, wherein the plurality of conducting elements includes five conducting elements.

5. The antenna of claim 1, wherein the plurality of conducting elements are configured to include an angle of tilt between 22 degrees and 68 degrees from horizontal.

6. The antenna of claim 1, wherein the plurality of conducting elements are located within a printed circuit board that is wrapped around the circumference around the center axis.

7. The antenna of claim 1, wherein each conducting element of the plurality of conducting elements comprises a metallic wire.

8. An antenna comprising:

a cover comprising:

a base including an inner cylinder portion and a lower cylinder portion, the inner cylinder portion comprising an upper rim and a lower rim each comprising a plurality of notches; and a cap including an outer cylinder portion, the cap further comprising a rigid non-conductive material;

wherein the base and the cap form a cavity interior to the inner cylinder portion;

a center radiating element extending through an opening in the base such that a first end of the center radiating element is located within the cavity, wherein the center radiating element is aligned with a vertical center axis of the cover; and a plurality of conducting elements curved about a circumference around the center axis of the cover and spaced equidistantly about the circumference.

9. The antenna of claim 8, wherein the plurality of conducting elements are located within a space between the inner cylinder portion and the outer cylinder portion.

10. The antenna of claim 8, wherein each conducting element of the plurality of conducting elements are configured to include an angle of tilt between 22 degrees and 68 degrees from horizontal.

11. The antenna of claim 8, wherein the plurality of conducting elements are included within a printed circuit board that is wrapped around the circumference around the center axis of the cover.

12. The antenna of claim 8, wherein the plurality of conducting elements includes five conducting elements.

13. The antenna of claim 8, wherein each conducting element of the plurality of conducting elements comprises a copper wire.

14. The antenna of claim 8, wherein the radius ($r_i$), in inches, from the center axis to the plurality of conducting elements is equal to approximately 2.6535/f; wherein f is a desired operation frequency in gigahertz (GHz).

15. The antenna of claim 8, wherein the center radiating element is a coaxial cable.

16. A system comprising:

a receiver; and an antenna, the antenna comprising:

a cover comprising:

a base including an inner cylinder portion and a lower cylinder portion, the inner cylinder portion comprising an upper rim and a lower rim each comprising a plurality of notches; and a cap including an outer cylinder portion, the cap further comprising a rigid non-conductive material;

wherein the base and the cap form a cavity interior to the inner cylinder portion;

a center radiating element extending through an opening in the base such that a first end of the center radiating element is located within the cavity, wherein the center radiating element is aligned with a vertical center axis of the cover; and a plurality of conducting elements curved about a circumference around the center axis of the cover and spaced equidistantly about the circumference.

17. The system of claim 16, wherein the antenna is coupled to the receiver via a coaxial radio frequency (RF) connector located at a second end of the center radiating element.

18. The system of claim 16, wherein the center radiating element is directly coupled to a circuit board of the receiver.

19. The system of claim 16, wherein each conducting element of the plurality conducting elements are configured to include an angle of tilt between 22 degrees and 68 degrees from horizontal.

20. The antenna of claim 16, wherein each conducting element of the plurality of conducting elements are located within a space between the inner cylinder portion and the outer cylinder portion.

21. A method for constructing an antenna, the method comprising inserting a central radiating element through a first support collar such that an annular cavity is formed within the first support collar around the central radiating element;

joining the first support collar to a first end of the central radiating element;

extending a second end of the central radiating element through an opening in a cover base, the cover base including an inner cylinder portion defining a cavity, the inner cylinder portion comprising an upper rim and a lower rim each comprising a plurality of notches, wherein the second end of the central radiating element is located within the cavity of the inner cylinder portion;

wherein the central radiating element is aligned with a center axis of the cover base;

inserting the second end of the central radiating element through a second support collar such that the second support collar surrounds a portion of the central radiating element within the cavity;

joining the second support collar to the central radiating element;

positioning a plurality of conducting elements on the inner cylinder portion such that the conducting elements are curved about a circumference around the center axis of the cover and spaced equidistantly about the circumference; and covering the cover base with a cover cap such that the cover cap encloses the plurality of conducting elements, the cover cap comprising a rigid non-conductive material.

* * * * *